US006924606B2

(12) United States Patent
Yu et al.

(10) Patent No.: US 6,924,606 B2
(45) Date of Patent: Aug. 2, 2005

(54) LOW-VISUAL NOISE, JITTERIZED PULSE WIDTH MODULATION BRIGHTNESS CONTROL CIRCUIT

(75) Inventors: Andre Yu, Taipei (TW); Jeffrey Chang, Taipei (TW); Bill Huang, Jhonghe (TW)

(73) Assignee: Beyond Innovation Technology Co., Ltd., Taipei (TW)

( * ) Notice: Subject to any disclaimer, the term of this patent is extended or adjusted under 35 U.S.C. 154(b) by 0 days.

(21) Appl. No.: 10/712,246

(22) Filed: Nov. 12, 2003

(65) Prior Publication Data

US 2005/0057170 A1 Mar. 17, 2005

(30) Foreign Application Priority Data

Sep. 16, 2003 (TW) ..... 92125460 A

(51) Int. Cl.[7] ..... G05F 1/00

(52) U.S. Cl. ..... 315/291; 315/194; 315/224; 315/307

(58) Field of Search ..... 315/291, 194, 315/224, 307, DIG. 2, DIG. 4, DIG. 5; 345/211–212, 690–691, 87, 102

(56) References Cited

U.S. PATENT DOCUMENTS

| | | | | | |
|---|---|---|---|---|---|
| 5,272,327 | A | * | 12/1993 | Mitchell et al. | 250/205 |
| 5,786,801 | A | * | 7/1998 | Ichise | 345/102 |
| 6,396,217 | B1 | * | 5/2002 | Weindorf | 315/169.1 |
| 6,762,742 | B2 | * | 7/2004 | Moon et al. | 345/102 |
| 2003/0142118 | A1 | * | 7/2003 | Funamoto et al. | 345/691 |
| 2003/0151601 | A1 | * | 8/2003 | Chung et al. | 345/211 |
| 2004/0061708 | A1 | * | 4/2004 | Oh | 345/690 |
| 2004/0155853 | A1 | * | 8/2004 | Lin | 345/102 |

* cited by examiner

*Primary Examiner*—Thuy Vinh Tran
(74) *Attorney, Agent, or Firm*—J.C Patents

(57) ABSTRACT

A low visual noise, jitterized pulse width modulation brightness control circuit is provided. The circuit uses a brightness control signal generating unit to receive a brightness adjusting signal and to generate a brightness control signal in response to the brightness adjusting signal. The brightness control pulse signal has a duty cycle or frequency varying in a predetermined range. An inverter coupled to the brightness control signal generating unit drives the fluorescent lamp in response to the brightness control pulse signal to reduce the visual interference due to the adjustment of the current beam density.

7 Claims, 3 Drawing Sheets

LOW-VISUAL NOISE, JITTERIZED PULSE WIDTH MODULATION BRIGHTNESS CONTROL CIRCUIT

CROSS-REFERENCE TO RELATED APPLICATION

This application claims the priority benefit of Taiwan application Ser. No. 92125460, filed on Sep. 16, 2003.

BACKGROUND OF THE INVENTION

1. Field of the Invention

This invention generally relates to a dimmer control circuit, and more particularly to a low visual noise dimmer control circuit by adjusting current beam density.

2. Description of Related Art

Liquid crystal displays (LCD) have been widely used to replace the conventional CRT displays. As the semiconductor manufacturing technology advances, LCD has several advantages such as low power consumption, light weight, high resolution, high color saturation, and longer lifetime, and can be used in state-of-the-art electronic devices such as digital cameras, notebook computers, desktop computers, mobile phones, personal digital assistant (PDA), global positioning system (GPS), etc.

Because LCD is not self-emitting, a cold cathode fluorescent lamp (CCFL) is used as a light source. For stable operation of the cold cathode fluorescent lamp, the power source is a sinusoidal signal having a frequency between 30 KHz and 80 KHz without DC component. The stable operational voltage is approximately a constant. The brightness of the lamp depends on the current through the lamp.

For a large size LCD application, the signal with a high frequency and a high voltage for driving the lamp will leak via the parasitic capacitor between the lamp and the panel. Hence, when the current through the lamp is small, the so-called thermal meter effect is generated in which the ground end is darker than the high-voltage end of the lamp, or the lamp cannot emit light. To overcome the thermal meter effect, the conventional method dims the lamp by fixing the amplitude of the current through the lamp and adjusting the current beam density to obtain a maximum dimming range.

FIG. 1 is the block diagram for the conventional jitterized pulse width modulation brightness control circuit. FIG. 2 is a schematic diagram showing the relationship between the brightness control pulse signal and the fluorescent light driving current signal of the circuit of FIG. 1. As shown in FIG. 1, the brightness control signal Con is sent to the inverter 110 to control the fluorescent light driving current signal Id. FIGS. 2(*a*), (*b*), and (*c*) illustrate the outputted wavelength of the fluorescent light driving current signal ID controlled by three different pulse widths. FIG. 2(*a*), (*b*), (*c*) show that the brightness is 100%, 20%, and 50% respectively.

To prevent users from visual interference due to the on/off frequency of the fluorescent light, the frequency of the brightness control signal Con has to be kept at a certain level, such as, 200 Hz. Hence, eyes of an individual will not blink due to the changes of the brightness of the fluorescent light.

Because the frequency of the brightness control signal is fixed based on the required brightness, when the lamp is used for LCD back light, the back light signal would interfere the vertical and horizontal video signals due to the frequency difference. The frequency difference between the back light signal and the video signals would cause the so-called "fan effect", in which ripples are formed on the display. Further, the frequency of switching the inverter also affects the power source of the inverter, which causes the power source to generate the ripples having the same frequency as the brightness control signal. The generated ripples also affect the scan signal, which causes glistening on the display.

To avoid interference generated between the back light signal and the vertical and horizontal scan signals due to the frequency difference, one can synchronize and double the frequencies of the brightness control pulse signal and the horizontal scan signal. However, it requires a higher cost. Another solution is to increase the frequency of the brightness control signal to reduce the interference to the power source. However, for a large size LCD, it is more and more difficult to achieve a low-noise and a wide dimming range lamp solution.

SUMMARY OF THE INVENTION

An object of the present invention is to provide a low visual noise pulse width modulation (PWM) brightness control circuit by adjusting the frequency or period of the brightness control pulse signal and maintain the average operational frequency or period to reduce the visual interference generated by jitterized pulse width modulation brightness control.

The present invention provides a low visual noise, jitterized pulse width modulation brightness control circuit, for adjusting a brightness of a fluorescent lamp in a liquid crystal display comprising: a brightness control signal generating unit receiving a brightness adjusting signal and generating a brightness control signal in response to the brightness adjusting signal, the brightness control signal having an operational period varying in a predetermined range; and a inverter coupled to the brightness control signal generating unit driving the fluorescent lamp in response to the brightness control signal.

In a preferred embodiment of the present invention, the brightness control signal generating unit comprises: a noise generator generating a noise; an analog adder, coupled to the noise generator, receiving and adding the brightness adjusting signal and the noise; and a comparator, couple to the analog adder, comparing the added the brightness adjusting signal and the noise and a triangle wave to generate the brightness control signal.

In a preferred embodiment of the present invention, the noise level is adjustable.

The present invention provides a low visual noise brightness control circuit, for adjusting a brightness of a fluorescent lamp in a liquid crystal display comprising: a brightness control signal generating unit receiving a brightness adjusting signal and generating a brightness control signal in response to the brightness adjusting signal, the brightness control signal having an operational frequency varying in a predetermined range; and a inverter coupled to the brightness control signal generating unit driving the fluorescent lamp in response to the brightness control signal.

In a preferred embodiment of the present invention, the brightness control signal generating unit is a microprocessor.

In a preferred embodiment of the present invention, the brightness control signal has a phase varying in a predetermined range.

Therefore, the low visual noise dimmer control circuit of the present invention can reduce the interference due to adjustment of the current beam density by adjusting the frequency or period of the brightness control signal and maintain the average operational frequency or frequency of the brightness control signal.

The above is a brief description of some deficiencies in the prior art and advantages of the present invention. Other features, advantages and embodiments of the invention will be apparent to those skilled in the art from the following description, accompanying drawings and appended claims.

DESCRIPTION OF THE PREFERRED EMBODIMENTS

Figure 1:
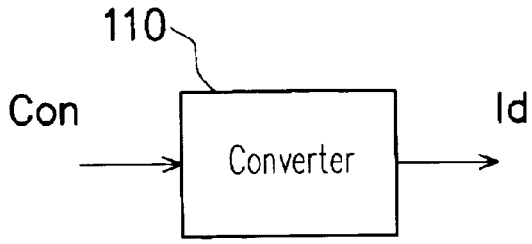
FIG. 1 (PRIOR ART)
FIG. 1 is the conventional dimmer control circuit by adjusting the current beam density.
Figure 2:
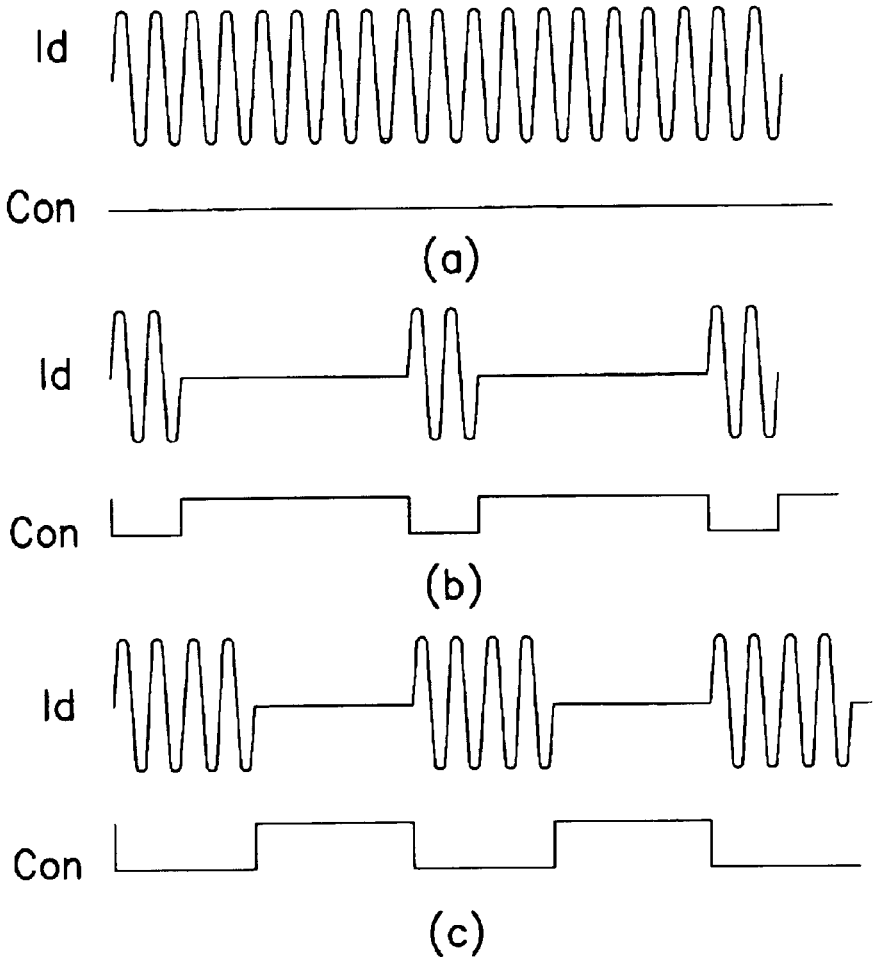
FIG. 2 (PRIOR ART)
FIG. 2 shows the relationship between the brightness control signal and the driving current signal for driving the lamp as shown in FIG. 1.
Figure 3:
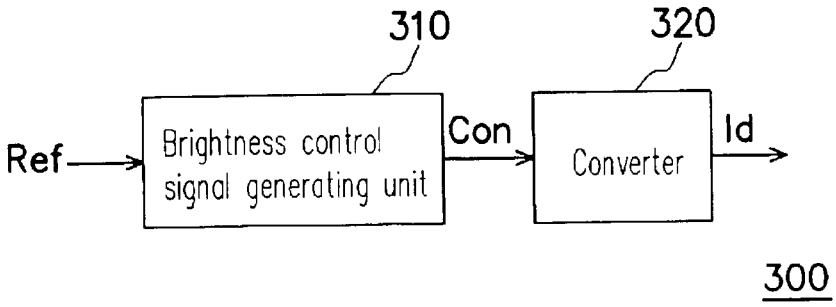
FIG. 3 is a block diagram of the low visual noise brightness control circuit in accordance with a preferred embodiment of the present invention.

FIG. 3 is a block diagram of the low visual noise, jitterized pulse width modulation brightness control circuit in accordance with a preferred embodiment of the present invention. The low visual noise, jitterized pulse width modulation brightness control circuit 300 is suitable for adjusting the brightness of a fluorescent lamp (not shown) in a liquid crystal display.

As shown in FIG. 3, the low visual noise, jitterized pulse width modulation brightness control circuit 300 includes a brightness control pulse signal generating unit 310 and an inverter 320. The brightness control pulse generating unit 310 receives a brightness adjusting signal Ref and generates a brightness control pulse signal Con in response to the brightness adjusting signal Ref. To prevent the visual interference due to adjustment of the current beam density, the brightness control pulse signal Con has a duty cycle or frequency varying in a predetermined range so that the brightness control pulse signal Con would not interfere with the vertical and horizontal scan signals. The fan effect, in which ripples are formed on the screen due to the frequency difference between the frequencies of the brightness control pulse signal Con and the scan signals is eliminated. The inverter 320 is coupled to the brightness control pulse generating unit 310 to drive the fluorescent lamp in response to the brightness control signal Con.

Figure 4:
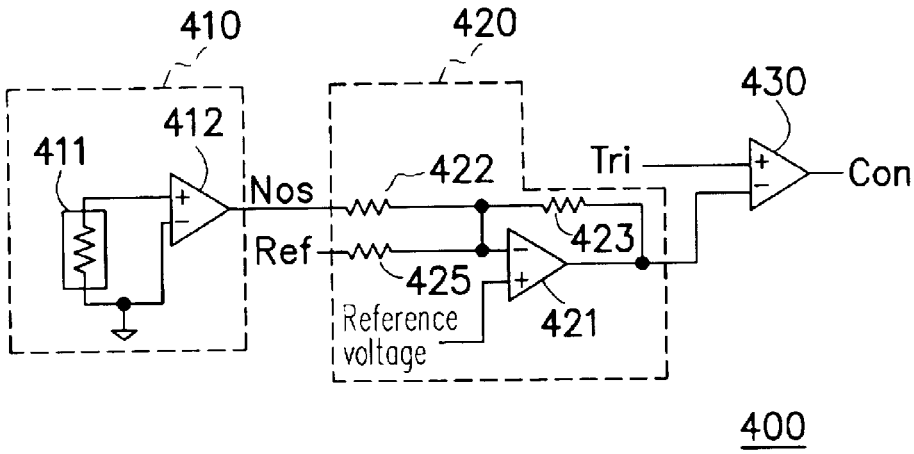
FIG. 4 the circuit of the brightness control signal generating unit in accordance with a preferred embodiment of the present invention.

FIG. 4 is a schematic circuit diagram of the brightness control pulse generating unit in accordance with a preferred embodiment of the present invention. The brightness control signal generating unit 400 receives the brightness adjusting signal Ref and generates a brightness control signal Con having an operational period varying in a predetermined range in response to the brightness adjusting signal Ref to reduce the visual interference.

Referring to FIG. 4, the brightness control signal generating unit 400 includes a noise generator 410 comprising a resistor 411 and an amplifier 412, an analog adder 420 comprising resistors 422, 423, and 425 and an amplifier 421, and a comparator 430. The noise generator 410 generates a noise Nos by amplifying the thermal noise from the resistor 411 by the amplifier 412. The noise Nos is then sent to the analog adder 420. The analog adder 420 adds the noise Nos and the brightness adjusting signal Ref to generate an added signal having brightness adjusting signal Ref and the noise Nos. The resistor 422 can be an adjustable resistor to adjust the level of the noise Nos. The added signal is sent to the comparator 430. The comparator 430 compares the added signal and a triangle wave Tri to generate the brightness control signal Con.

Figure 5:
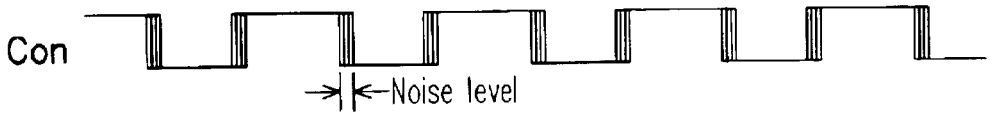
FIG. 5 shows the brightness control signal generated by the brightness control signal generator of FIG. 4.

As shown in FIG. 5, although the operational period of the brightness control signal Con is different at each instant, the average power of the noise is zero. Hence, the average operational period of the brightness control signal Con by adding the noise Nos is the same as the average operational period of the brightness control signal Con without the noise Nos. In other words, the brightness of the fluorescent light is still the same even after the noise Nos is added into the circuit.

Figure 6:
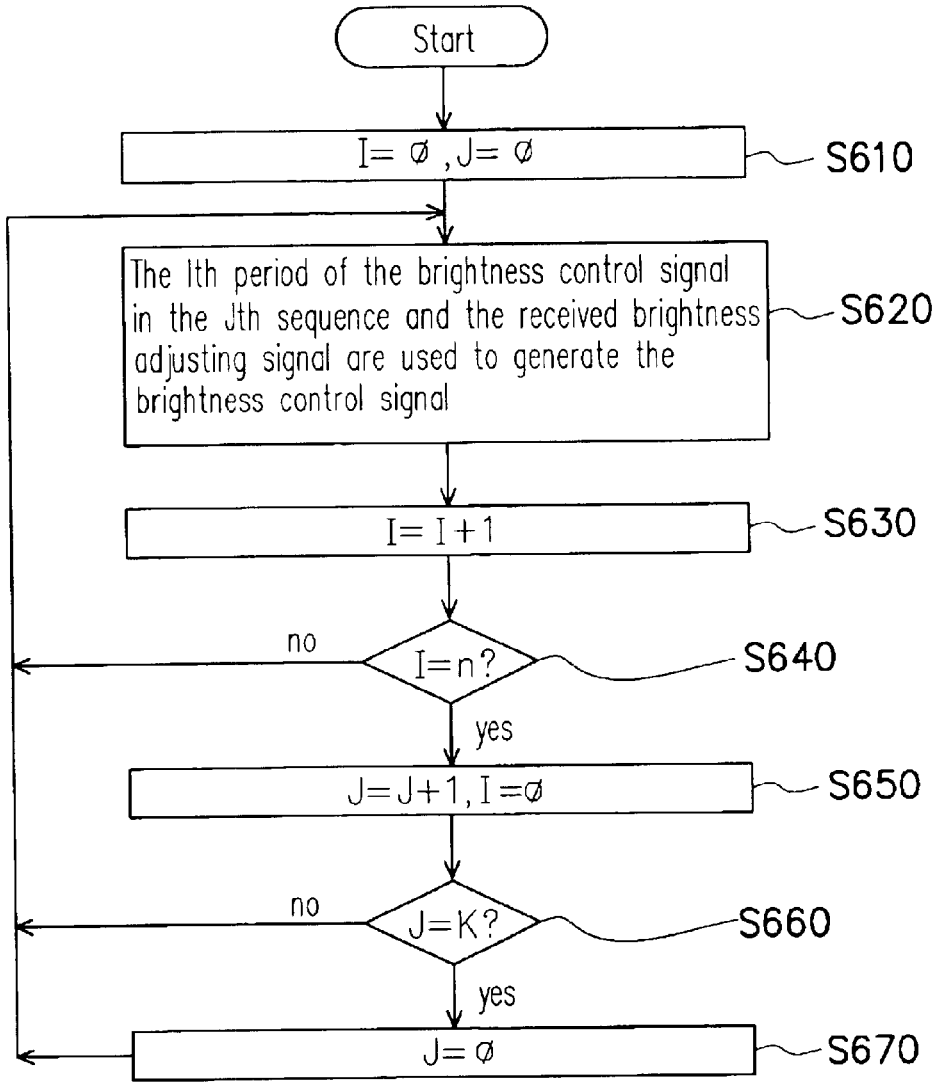
FIG. 6 shows the flow chart of generating the brightness control signal in accordance with a preferred embodiment of the present invention.

FIG. 6 shows the flow chart of generating the brightness control signal in accordance with a preferred embodiment of the present invention. If the brightness control signal generating unit 310 is implemented by a microprocessor, this flow chart can be used to generate the brightness control signal Con with a predetermined frequency-varying range in response to the brightness adjusting signal Ref, thereby reducing the visual interference due to the adjustment of the current beam density.

Assuming that the frequency of the brightness control signal Con is F=1/T, wherein T is the period of the brightness control pulse signal Con. We can set n periods of the brightness control signal Con as T0, T1, T2, . . . Tn-1 and (T0+T1+T2+ . . . Tn-1)/n=T. Then K different sequences of the n periods of the brightness control signal Con can be arranged to be inputted into the inverter. For example, Sequence 0 is {T0, T1, T2, . . . , Tn-1}

Sequence 1 is {T0, T2, . . . }

. . .

Then the microprocessor can be used to perform the flow chart in FIG. 6 based on the K different sequences to output the brightness control signal Con with different frequencies. The brightness control signal generating unit for low visual noise performs as follows.

First the variants I and J are set to be zero in step (S610). Then the Ith period of the brightness control signal in the Jth sequence and the received brightness adjusting signal are used to generate the brightness control signal in step (S620). Then set I=I+1 in order to obtain the next period of the brightness control signal in the Jth sequence in step (S630). Then in step S640, whether I=n is determined. If I≠n, then the flow chart goes back to step S620. If I=n, then I is set to be zero and J=J+1 in order to obtain the first period of the brightness control signal in the next sequence in step (S650). Then in step S660 whether J=K is determined. If J≠K, then the flow chart goes back to S620. If J=K, then J is set to be zero and the flow chart goes back to S620.

The above embodiment uses K sequences as an example. One skilled on the art may set K=1 to simplify the process. In addition, one can set the phase of the brightness control signal varying in a predetermined range in order to generate a brightness control signal with a wider frequency range.

The above description provides a full and complete description of the preferred embodiments of the present invention. Various modifications, alternate construction, and equivalent may be made by those skilled in the art without changing the scope or spirit of the invention. Accordingly, the above description and illustrations should not be construed as limiting the scope of the invention which is defined by the following claims.

What is claimed is:

1. A low visual noise, jitterized pulse width modulation brightness control circuit, for adjusting a brightness of a fluorescent lamp in a liquid crystal display comprising:

a brightness control signal generating unit receiving a brightness adjusting signal and generating a brightness control signal in response to said brightness adjusting signal, said brightness control signal having an operational period varying in a predetermined range, wherein said brightness control signal drives the fluorescent lamp so that back light signals generated by the fluorescent lamp have the same frequency as vertical scanning signals and horizontal scanning signals; and an inverter coupled to said brightness control signal generating unit driving said fluorescent lamp in response to said brightness control signal.

2. The circuit of claim 1, wherein said brightness control signal generating unit comprises:

a noise generator generating a noise;

an analog adder, coupled to said noise generator, receiving and adding said brightness adjusting signal and said noise; and a comparator, couple to said analog adder, comparing said added brightness adjusting signal and said noise and a triangle wave to generate said brightness control signal.

3. The circuit of claim 2, wherein said noise level is adjustable.

4. A low visual noise, jitterized pulse width modulation brightness control circuit, for adjusting a brightness of a fluorescent lamp in a liquid crystal display comprising:

a brightness control signal generating unit receiving a brightness adjusting signal and generating a brightness control signal in response to said brightness adjusting signal, said brightness control signal having an operational frequency varying in a predetermined range, wherein said brightness control signal drives the fluorescent lamp so that back light signals generated by the fluorescent lamp have the same frequency as vertical scanning signals and horizontal scanning signals; and an inverter coupled to said brightness control signal generating unit driving said fluorescent lamp in response to said brightness control signal.

5. The circuit of claim 4, wherein said brightness control signal generating unit is a microprocessor.

6. The circuit of claim 4, wherein said brightness control signal has a phase varying in a predetermined range.

7. A low visual noise, jitterized pulse width modulation brightness control circuit, for adjusting a brightness of a fluorescent lamp in a liquid crystal display comprising:

a brightness control signal generating unit receiving a brightness adjusting signal and generating a brightness control signal in response to said brightness adjusting signal, said brightness control signal having an operational period varying in a predetermined range; and an inverter coupled to said brightness control signal generating unit driving said fluorescent lamp in response to said brightness control signal;

wherein said brightness control signal generating unit comprises:

a noise generator generating a noise;

an analog adder, coupled to said noise generator, receiving and adding said brightness adjusting signal and said noise; and a comparator, couple to said analog adder, comparing said added brightness adjusting signal and said noise and a triangle wave to generate said brightness control signal.

* * * * *